US008562810B2

(12) United States Patent
Sanville et al.

(10) Patent No.: US 8,562,810 B2
(45) Date of Patent: Oct. 22, 2013

(54) ON SITE GENERATION OF ALKALINITY BOOST FOR WARE WASHING APPLICATIONS

(75) Inventors: Katherine M. Sanville, White Bear Lake, MN (US); Clinton Hunt, Jr., Lakeville, MN (US); Barry R. Taylor, Adrian, MI (US)

(73) Assignee: Ecolab USA Inc., Saint Paul, MN (US)

( * ) Notice: Subject to any disclaimer, the term of this patent is extended or adjusted under 35 U.S.C. 154(b) by 40 days.

(21) Appl. No.: 13/190,944

(22) Filed: Jul. 26, 2011

(65) Prior Publication Data

US 2013/0026046 A1 Jan. 31, 2013

(51) Int. Cl.
*C25B 1/16* (2006.01)
*C11D 7/12* (2006.01)

(52) U.S. Cl.
USPC ..... 205/349; 205/510; 205/687; 205/770; 510/108; 510/218

(58) Field of Classification Search
USPC ..... 205/510, 516, 687, 746, 769, 770, 349; 510/179, 197, 218–237
See application file for complete search history.

(56) References Cited

U.S. PATENT DOCUMENTS

| | | | | |
|---|---|---|---|---|
| 1,284,618 | A | | 11/1918 | Dow |
| 3,463,709 | A | | 8/1969 | Russell |
| 3,616,355 | A | | 10/1971 | Themy et al. |
| 3,869,376 | A | | 3/1975 | Tejeda |
| 3,884,778 | A | | 5/1975 | Eng et al. |
| 3,893,897 | A | | 7/1975 | Raetzsch et al. |
| 3,904,496 | A | | 9/1975 | Harke et al. |
| 3,954,581 | A | | 5/1976 | Carlin |
| 3,963,592 | A | | 6/1976 | Lindstrom |
| 4,035,255 | A | | 7/1977 | Gritzner |
| 4,062,754 | A | | 12/1977 | Eibl |
| 4,065,367 | A | | 12/1977 | de Nora |
| 4,100,052 | A | | 7/1978 | Stillman |
| 4,105,515 | A | | 8/1978 | Ogawa et al. |
| 4,118,305 | A | | 10/1978 | Oloman et al. |
| 4,191,618 | A | | 3/1980 | Coker et al. |
| 4,221,644 | A | | 9/1980 | LaBarre |
| 4,224,129 | A | | 9/1980 | McIntyre et al. |
| 4,253,922 | A | | 3/1981 | Welch |
| 4,256,545 | A | | 3/1981 | Deborski |
| 4,256,551 | A | | 3/1981 | Cliff et al. |
| 4,299,682 | A | | 11/1981 | Oda et al. |
| 4,305,793 | A | | 12/1981 | Broniewski |
| 4,313,813 | A | | 2/1982 | Johnson et al. |
| 4,315,805 | A | | 2/1982 | Darlington et al. |
| 4,332,662 | A | | 6/1982 | Pouli et al. |
| 4,337,126 | A | * | 6/1982 | Gilligan et al. ..... 205/349 |
| 4,340,459 | A | | 7/1982 | McIntyre et al. |
| 4,350,575 | A | | 9/1982 | Porta et al. |
| 4,350,608 | A | | 9/1982 | Gestaut |
| 4,364,805 | A | | 12/1982 | Rogers |
| 4,364,806 | A | | 12/1982 | Rogers |
| 4,376,691 | A | | 3/1983 | Lindstrom |
| 4,379,034 | A | | 4/1983 | Rogers |
| 4,415,413 | A | | 11/1983 | Veber |
| 4,416,758 | A | | 11/1983 | Tseung et al. |
| 4,430,176 | A | | 2/1984 | Davison |
| 4,436,608 | A | | 3/1984 | Bennett et al. |
| 4,457,813 | A | | 7/1984 | Rogers et al. |
| 4,464,238 | A | | 8/1984 | Caldwell et al. |
| 4,465,573 | A | | 8/1984 | O'Hare |
| 4,486,276 | A | | 12/1984 | Cohn et al. |
| 4,561,945 | A | | 12/1985 | Coker et al. |
| 4,572,774 | A | | 2/1986 | Wrighton et al. |
| 4,627,897 | A | | 12/1986 | Tetzlaff et al. |
| 4,647,351 | A | | 3/1987 | Gelb |
| 4,687,561 | A | | 8/1987 | Kunz |
| 4,753,718 | A | | 6/1988 | Chiang |
| 4,758,317 | A | | 7/1988 | Chiang |
| 4,761,208 | A | | 8/1988 | Gram et al. |
| 4,839,004 | A | | 6/1989 | Castellini |

(Continued)

FOREIGN PATENT DOCUMENTS

| | | | |
|---|---|---|---|
| EP | 0 199 957 | A1 | 12/1986 |
| EP | 1 673 974 | A1 | 6/2006 |
| GB | 832196 | | 4/1960 |
| GB | 2 352 728 | A | 2/2001 |
| JP | 07328638 | A | 12/1995 |
| JP | 2003-126861 | A | 5/2003 |
| WO | WO 98/13304 | A1 | 4/1998 |
| WO | WO 02/102716 | A1 | 12/2002 |
| WO | WO 2004/009498 | A1 | 1/2004 |
| WO | WO 2004/031077 | A2 | 4/2004 |
| WO | WO 2006/121494 | A2 | 11/2006 |
| WO | WO 2007/004971 | A1 | 1/2007 |
| WO | WO 2008/042662 | A1 | 4/2008 |

OTHER PUBLICATIONS

Forti, Juliane C. et al., "Effects of the Modification of Gas Diffusion Electrodes by Organic Redox Catalysts for Hydrogen Peroxide Electrosynthesis", J. Braz. Chem. Soc., 2008, vol. 19, No. 4, 643-650.
Da Pozzo, Anna et al., "Electrogeneration of hydrogen peroxide in seawater and application to disinfection", J. appl. Electrochem (2008) 38:997-1003.

(Continued)

*Primary Examiner* — Keith Hendricks
*Assistant Examiner* — Steven A. Friday
(74) *Attorney, Agent, or Firm* — McKee, Voorhees & Sease, P.L.C.

(57) ABSTRACT

Methods for enhancing alkalinity and performance of ash-based detergents are disclosed. Nonhazardous ash-based detergent alkalinity is enhanced through increasing the ratio of sodium hydroxide to ash-based alkalinity. Methods according to the invention do not require the addition of chemical ingredients, do not generate additional waste streams and use the entirety of the ash-based detergent. The methods according to the invention provide alkalinity-enhanced detergent use solutions that are sufficiently concentrated for adequate cleaning capability while only requiring minimal amounts of the use solution to be dispensed for an in situ cleaning process.

20 Claims, 4 Drawing Sheets

(56) References Cited

U.S. PATENT DOCUMENTS

| | | | | |
|---|---|---|---|---|
| 4,891,107 | A | 1/1990 | Dong et al. | |
| 4,927,509 | A | 5/1990 | Mathur et al. | |
| 4,964,970 | A | 10/1990 | O'Hare | |
| 4,969,981 | A | 11/1990 | Rogers et al. | |
| 5,246,551 | A | 9/1993 | Pletcher et al. | |
| 5,313,589 | A | 5/1994 | Donaldson et al. | |
| 5,316,629 | A | 5/1994 | Clifford et al. | |
| 5,358,609 | A | 10/1994 | Drackett | |
| 5,427,667 | A | 6/1995 | Bakhir et al. | |
| 5,445,722 | A | 8/1995 | Yamaguti et al. | |
| 5,445,772 | A | 8/1995 | Uchida et al. | |
| 5,507,932 | A | 4/1996 | Robinson | |
| 5,536,379 | A | 7/1996 | Nonaka et al. | |
| 5,616,221 | A | 4/1997 | Aoki et al. | |
| 5,624,535 | A | 4/1997 | Tsuchikawa et al. | |
| 5,628,888 | A | 5/1997 | Bakhir et al. | |
| 5,635,040 | A | 6/1997 | Bakhir et al. | |
| 5,645,700 | A | 7/1997 | White et al. | |
| 5,650,058 | A | 7/1997 | Wenske et al. | |
| 5,674,365 | A | 10/1997 | Sano | |
| 5,695,622 | A | 12/1997 | Fraser et al. | |
| 5,723,095 | A | 3/1998 | Fricker et al. | |
| 5,728,274 | A | 3/1998 | Kamitani et al. | |
| 5,770,033 | A | 6/1998 | Murphy et al. | |
| 5,770,035 | A | 6/1998 | Faita | |
| 5,783,052 | A | 7/1998 | Bakhir et al. | |
| 5,783,790 | A | 7/1998 | Mitsumori et al. | |
| 5,827,412 | A | 10/1998 | Shimamune et al. | |
| 5,871,623 | A | 2/1999 | Bakhir et al. | |
| 5,879,521 | A | 3/1999 | Shimamune et al. | |
| 5,897,757 | A | 4/1999 | Sano | |
| 5,932,171 | A | 8/1999 | Malchesky | |
| 5,938,901 | A | 8/1999 | Shimamune et al. | |
| 5,948,220 | A | 9/1999 | Kamitani et al. | |
| 5,954,939 | A | 9/1999 | Kanekuni et al. | |
| 5,985,109 | A | 11/1999 | Hara | |
| 5,985,110 | A | 11/1999 | Bakhir et al. | |
| 5,997,717 | A * | 12/1999 | Miyashita et al. | 205/466 |
| 6,004,439 | A | 12/1999 | Bakhir et al. | |
| 6,004,449 | A | 12/1999 | Vetrovec | |
| 6,007,696 | A | 12/1999 | Takayasu et al. | |
| 6,022,512 | A | 2/2000 | Tanaka et al. | |
| 6,039,853 | A | 3/2000 | Gestermann et al. | |
| 6,096,177 | A | 8/2000 | Kamitani et al. | |
| 6,113,773 | A | 9/2000 | Shimamune et al. | |
| 6,117,285 | A | 9/2000 | Welch et al. | |
| 6,117,286 | A | 9/2000 | Shimamune et al. | |
| RE36,972 | E | 11/2000 | Baker et al. | |
| 6,143,163 | A | 11/2000 | Sawamoto et al. | |
| 6,159,349 | A | 12/2000 | Wakita et al. | |
| 6,187,154 | B1 | 2/2001 | Yamaguchi et al. | |
| 6,224,744 | B1 | 5/2001 | Casado Gimenez et al. | |
| 6,235,186 | B1 | 5/2001 | Tanaka et al. | |
| 6,254,762 | B1 | 7/2001 | Uno et al. | |
| 6,298,996 | B1 | 10/2001 | Spiegel et al. | |
| 6,358,381 | B1 | 3/2002 | Allen et al. | |
| 6,387,238 | B1 | 5/2002 | Merk et al. | |
| 6,391,169 | B1 | 5/2002 | Hara et al. | |
| 6,524,450 | B1 | 2/2003 | Hara | |
| 6,585,867 | B1 | 7/2003 | Asano | |
| 6,592,727 | B2 | 7/2003 | Yamamoto | |
| 6,623,695 | B2 | 9/2003 | Malchesky et al. | |
| 6,712,949 | B2 | 3/2004 | Gopal | |
| 6,719,891 | B2 | 4/2004 | Ruhr et al. | |
| 6,773,575 | B2 | 8/2004 | Nakajima et al. | |
| 6,790,339 | B2 | 9/2004 | Bulan et al. | |
| 6,797,136 | B2 | 9/2004 | Shimamune | |
| 6,869,518 | B2 | 3/2005 | Kadlec et al. | |
| 6,869,714 | B2 | 3/2005 | Nishiki et al. | |
| 6,921,743 | B2 | 7/2005 | Scheper et al. | |
| 6,923,893 | B2 | 8/2005 | Sano | |
| 6,949,178 | B2 | 9/2005 | Tennakoon et al. | |
| 7,008,523 | B2 | 3/2006 | Herrington | |
| 7,025,868 | B2 | 4/2006 | Bunn et al. | |
| 7,090,753 | B2 | 8/2006 | Sumita | |
| 7,094,329 | B2 | 8/2006 | Saha et al. | |
| 7,186,323 | B2 | 3/2007 | Hara | |
| 7,238,272 | B2 | 7/2007 | Sano | |
| 7,261,905 | B2 | 8/2007 | Arata et al. | |
| 7,276,255 | B2 | 10/2007 | Selkon | |
| 7,341,654 | B2 | 3/2008 | Twardowski et al. | |
| 7,413,637 | B2 | 8/2008 | Scheper et al. | |
| 7,422,668 | B2 | 9/2008 | Cross | |
| 7,432,013 | B2 | 10/2008 | Kishi et al. | |
| 7,442,288 | B2 | 10/2008 | Sumita | |
| 7,625,470 | B2 | 12/2009 | Wright et al. | |
| 7,658,835 | B2 | 2/2010 | Gestermann et al. | |
| 7,670,472 | B2 | 3/2010 | Faita et al. | |
| 7,681,278 | B2 | 3/2010 | Chugun | |
| 7,708,867 | B2 | 5/2010 | Yamada et al. | |
| 7,749,370 | B2 | 7/2010 | Sumita | |
| 7,754,064 | B2 | 7/2010 | Buschmann et al. | |
| 7,816,314 | B2 | 10/2010 | Scheper et al. | |
| 7,857,953 | B2 | 12/2010 | Yamada et al. | |
| 7,955,481 | B2 | 6/2011 | Sanchez et al. | |
| 7,967,958 | B2 | 6/2011 | Sano | |
| 2003/0213503 | A1 * | 11/2003 | Price et al. | 205/744 |
| 2004/0020787 | A1 | 2/2004 | Sano | |
| 2004/0053098 | A1 | 3/2004 | Schiffrin et al. | |
| 2004/0250323 | A1 * | 12/2004 | Arai et al. | 204/257 |
| 2005/0121334 | A1 | 6/2005 | Sumita | |
| 2005/0139808 | A1 | 6/2005 | Alimi | |
| 2005/0142157 | A1 | 6/2005 | Alimi | |
| 2005/0252538 | A1 | 11/2005 | Vernon et al. | |
| 2006/0037869 | A1 | 2/2006 | Mitchke | |
| 2006/0096618 | A1 | 5/2006 | Price et al. | |
| 2006/0260954 | A1 | 11/2006 | Sano et al. | |
| 2007/0051640 | A1 | 3/2007 | Bellamy | |
| 2007/0261723 | A1 | 11/2007 | Price et al. | |
| 2008/0164152 | A1 | 7/2008 | Sanchez et al. | |
| 2008/0264778 | A1 | 10/2008 | Joshi et al. | |
| 2008/0292537 | A1 | 11/2008 | Sano | |
| 2009/0008236 | A1 | 1/2009 | Leng et al. | |
| 2009/0008263 | A1 | 1/2009 | Achiwa | |
| 2009/0110749 | A1 | 4/2009 | Norton et al. | |
| 2009/0114598 | A1 | 5/2009 | van Kralingen et al. | |
| 2009/0200234 | A1 | 8/2009 | Schacht et al. | |
| 2009/0229992 | A1 | 9/2009 | Sanchez et al. | |
| 2010/0314261 | A1 | 12/2010 | Perry | |

OTHER PUBLICATIONS

Guillet, N. et al., "Electrogeneration of hydrogen peroxide in acid medium using pyrolyzed cobalt-based catalysts: Influence of the cobalt content on the electrode performance", Journal of Applied Electrochemistry, (2006), 36:863-870.

Giomo, M. et al., "A small-scale pilot plant using an oxygen-reducing gas-diffusion electrode for hydrogen peroxide electrosynthesis", Electrochimica Acta 54 (2008), 808-815.

Kuang, Fei et al., "Electrochemical impedance spectroscopy analysis for oxygen reduction reaction in 3.5% NaC1 solution", J. Solid State Electrochem (2009) 13:385-390.

Lipp, Ludwig et al., "Peroxide formation in a zero-gap chlor-alkali cell with an oxygen-depolarized cathode", Journal of Applied Electrochemistry (2005) 35:1015-1024.

Panizza, Marco et al., "Electrochemical generation of H2O2 in low ionic strength media on gas diffusion cathode fed with air", Electrochimica Acta 54 (2008), 876-878.

Raghu, S. et al., "Evaluation of electrochemical oxidation techniques for degradation of dye effluents—A comparative approach", Journal of Hazardous Materials, 171 (2009) 748-754.

Xu, W.Y. et al., "Electrochemical disinfection using the gas diffusion electrode system", Journal of Environmental Sciences—China, 2010, vol. 22, No. 2, p. 204-210.

Xu, W. Y. et al., "Killing of *Escherichia coli* using the gas diffusion electrode system", Water Science & Technology WST (2010), 61.1, p. 107-118.

* cited by examiner

| | %NaOH | %NaOH-2 | %Na2CO3 | %Na2CO3-2 |
|---|---|---|---|---|
| Batch 1 | 8.5 | 8.3 | 33.95 | 36.63 |
| Batch 2 | 5.9 | 5.1 | 34.20 | 38.04 |
| Batch 3/Spent Apex | 12.8 | 12.2 | 30.14 | 33.37 |

ON SITE GENERATION OF ALKALINITY BOOST FOR WARE WASHING APPLICATIONS

FIELD OF THE INVENTION

The invention relates to methods for improving performance of ash-based detergents for ware washing and other applications. In particular, the alkalinity and performance of a nonhazardous ash-based detergent is enhanced through the increase in sodium hydroxide alkalinity, similar to a booster effect for a detergent. Beneficially, the enhanced performance and alkalinity is achieved without the addition of chemical ingredients, providing a sustainable and nonhazardous composition using electrolysis to produce hydroxide alkalinity in-situ.

BACKGROUND OF THE INVENTION

Sodium carbonate detergents are often referred to as ash detergents and provide various benefits over sodium hydroxide detergents (often referred to as caustic detergents). Ash-based detergents are noncorrosive and may be designated as safe to touch, providing obvious benefits with regard to shipping and handling. As a result, ash-based detergents are generally accepted as consumer-friendly and environmentally-friendly products since they are less hazardous. Alternatively, caustic detergents must be packaged and handled as a corrosive product as they can be dangerous, causing burns to exposed skin, particularly in the concentrated form. As the alkalinity of the compositions increases, the possible risk to workers also increases. Great care must be taken to protect workers who handle concentrated highly alkaline materials. A need therefore exists for cleaning compositions that minimize the risks to workers but perform as alkaline cleaners.

Electrochemical or electrolytic cells are commonly used for a variety of purposes, such as a means for water treatment and generation of chemicals, including hypochlorite and/or caustic solutions for use in various sanitizing, cleaning and/or disinfecting purposes. In general, electrolysis uses an electric current to split water into its two constituent elements: hydrogen and oxygen. Electricity enters the water at a cathode, a negatively charged terminal, passes through the water and exits through an anode, a positively charged terminal. Hydrogen gas and hydroxyl ions are generated at the cathode (negatively charged electrical current) and oxygen gas and protons are generated at the anode (positively charged electrical current). The reaction of water in an electrolytic cell is a redox process, as an oxidation reaction occurs at the anode while a reduction reaction occurs at the cathode.

Recent research and development efforts have focused on the use of electrolysis for on-site generation of bleach and other cleaning solutions for certain housekeeping applications. However, there is a need for additional development in the field of electrolysis to provide suitable ware wash applications, such as enhanced ware washing detergents. Accordingly, it is an objective of the claimed invention to develop methods for boosting performance of ash based detergents by increasing the alkalinity attributed to hydroxide in ash-based detergents without requiring the addition of additives and/or harsh chemicals.

A further object of the invention is the development and implementation of electrochemical cells and electrolysis technology to provide enhanced alkalinity ash-based detergents.

A further object of the invention is a method for conversion of the ash in an ash-based detergent into hydroxide alkalinity in order to create an ash-based detergent providing at least the same or an improved level of alkalinity in comparison to a caustic detergent.

Still further, according to an embodiment of the invention, methods providing on site chemical conversion of ash-based detergents are provided without the use of additional chemical products for the chemical conversion of the ash-based detergents and without the creation of additional waste streams.

BRIEF SUMMARY OF THE INVENTION

An advantage of the invention is the alkalinity enhancement of ash-based detergents using electrolysis. It is an advantage of the present invention that nonhazardous ash-based detergents are used to generate hydroxide alkalinity without the use of additional chemical products and without the creation of additional waste streams for the chemical conversion. The alkalinity-enhanced ash-based detergents produced according to the methods of the invention may further be formulated to contain additional chemical products suited for a particular cleaning application (e.g. defoamers, antiredeposition agents and the like). However, according to the invention, the on-site electrolytic generation of hydroxide alkalinity in the ash-based detergents of the present invention, provides an efficient and sustainable means of increasing alkalinity and cleaning power of a detergent.

In an embodiment, the present invention provides methods of electrochemically increasing alkalinity of a detergent. According to the invention, increasing the alkalinity of an ash-based detergent with caustic (e.g. hydroxide alkalinity) compensates for other variables similar to a booster concept for a detergent use solution. The method includes providing an alkali metal carbonate source to an electrolytic cell, undergoing electrolysis, removing carbon dioxide from said sodium carbonate source, wherein said increased alkalinity is a result of increased hydroxide concentration and decreased carbonate concentration, and generating a detergent use solution having increased hydroxide alkalinity. According to a further embodiment the methods employ a sodium carbonate detergent that is added to an anode chamber and water is provided to a cathode chamber. The methods of the invention also preferably include the recirculation of an anode stream into a cathode chamber for additional electrolysis within the electrolytic cell until a preferred hydroxide alkalinity concentration is obtained in the detergent use solution.

According to preferred embodiments of the invention, the ratio of ash to hydroxide alkalinity is from about 90:10 to about 80:20, more preferably the ratio of ash to hydroxide alkalinity is from about 80:20 to about 70:30 as measured in the detergent use solution. The ratio of ash to hydroxide alkalinity, as used herein, refers to the molar ratio of the alkalinity of the detergent use solution. The ratio compares the amount of carbonate and hydroxide present as contributing to alkalinity in the detergent use solution.

In a further embodiment, the present invention provides methods of increasing alkalinity of a detergent use solution on site. The methods include undergoing electrolysis of a sodium carbonate detergent source, decreasing the ratio of ash to hydroxide alkalinity from about 100:0 to between about 95:5 to about 80:20 in a detergent use solution, and providing said detergent use solution to an onsite cleaning application. The methods of the invention may further employ continuous or batch modes of operation. Preferably the methods of the invention provide the same detergency as a caustic detergent and do not require the addition of other chemical products for effective detergency and/or do not generate additional waste streams.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

Figure 1:
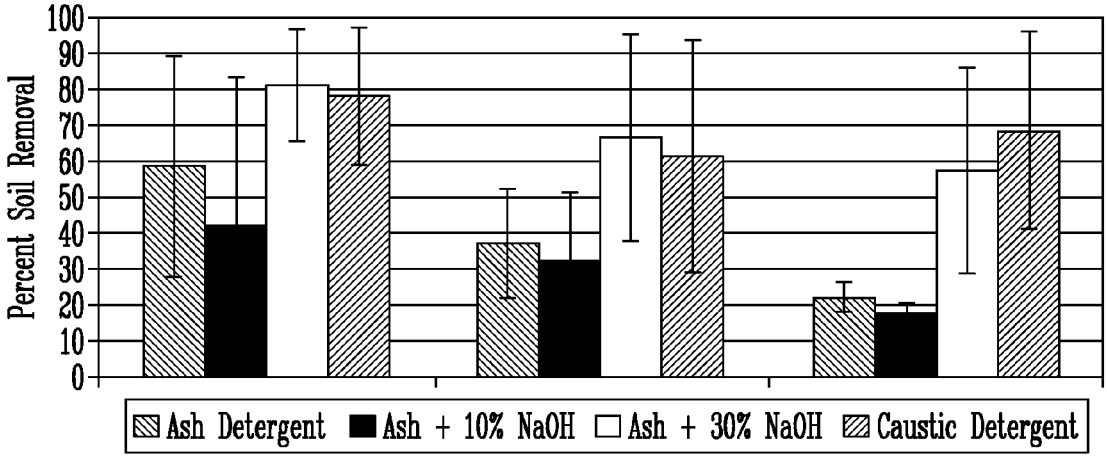
FIG. 1 shows a comparison of the percent soil removal of egg yolk from metal panels tested in high temperature automatic dishwashers using a solid caustic detergent compared to a solid ash-based detergent, with and without the addition of 10 and 30% sodium hydroxide to the ash-based detergent.

Various embodiments of the present invention will be described in detail with reference to the drawings, wherein like reference numerals represent like parts throughout the several views. Reference to various embodiments does not limit the scope of the invention. Figures represented herein are not limitations to the various embodiments according to the invention and are presented for exemplary illustration of the invention.

DETAILED DESCRIPTION OF THE PREFERRED EMBODIMENT

The present invention relates to methods of electrolysis to produce increased hydroxide alkalinity of ash-based detergents. The methods of increasing alkalinity of ash-based detergents and methods of cleaning therewith provide many advantages over conventional ash-based detergent products, which have the benefit of being nonhazardous yet often provide insufficient alkalinity for certain cleaning processes. However, the use of the nonhazardous ash-based detergents is often preferred over caustic detergents for a variety of reasons. The present invention meets the needs of providing a safe on site method for the maintained use of the often preferred ash-based detergents through the enhanced alkalinity of the products. The present invention provides numerous advantages along with demonstrating enhanced efficacy in various ware wash applications.

The embodiments of this invention are not limited to particular compositions, methods of enhancing ash-based detergent alkalinity and methods of cleaning therewith, which can vary and are understood by skilled artisans. It is further to be understood that all terminology used herein is for the purpose of describing particular embodiments only, and is not intended to be limiting in any manner or scope. For example, as used in this specification and the appended claims, the singular forms "a," "an" and "the" can include plural referents unless the content clearly indicates otherwise. Further, all units, prefixes, and symbols may be denoted in its SI accepted form. Numeric ranges recited within the specification are inclusive of the numbers defining the range and include each integer within the defined range.

So that the present invention may be more readily understood, certain terms are first defined. Unless defined otherwise, all technical and scientific terms used herein have the same meaning as commonly understood by one of ordinary skill in the art to which embodiments of the invention pertain. Many methods and materials similar, modified, or equivalent to those described herein can be used in the practice of the embodiments of the present invention without undue experimentation, the preferred materials and methods are described herein. In describing and claiming the embodiments of the present invention, the following terminology will be used in accordance with the definitions set out below.

The term "about," as used herein, refers to variation in the numerical quantity that can occur, for example, through typical measuring and liquid handling procedures used for making concentrates or use solutions in the real world; through inadvertent error in these procedures; through differences in the manufacture, source, or purity of the ingredients used to make the compositions or carry out the methods; and the like. The term "about" also encompasses amounts that differ due to different equilibrium conditions for a composition resulting from a particular initial mixture. Whether or not modified by the term "about", the claims include equivalents to the quantities refers to variation in the numerical quantity that can occur.

Term "antimicrobial composition," as used herein, refers to a composition having the ability to cause greater than a 90% reduction (1-log order reduction) in the population of bacteria or spores, such as *Bacillus* species within 10 seconds at 60° C. Preferably, *Bacillus cereus* or *Bacillus subtilis* are used in such procedure. Also preferably, the antimicrobial compositions of the invention provide greater than a 99% reduction (2-log order reduction), more preferably greater than a 99.99% reduction (4-log order reduction), and most preferably greater than a 99.999% reduction (5-log order reduction) in such population within 10 seconds at 60° C. Preferably, the antimicrobial compositions of the invention also provide greater than a 99% reduction (2-log order reduction), more preferably greater than a 99.99% reduction (4-log order reduction), and most preferably greater than a 99.999% reduction (5-log order reduction) in the population of one or more additional organisms such as the mold *Chaetomium funicola*. Because in their broadest sense these definitions for antimicrobial activity are different from some of the current governmental regulations, the use in connection with this invention of the term "antimicrobial" is not intended to indicate compliance with any particular governmental standard for antimicrobial activity.

The term "antiredeposition agent," as used herein, refers to a compound that helps keep a soil composition suspended in water instead of redepositing onto the object being cleaned.

The term "chlorine," as used herein, refers to chlorine compounds and chlorine oxyanions that exist in an electrolytically-generated solution (i.e. electrolysis solution). According to the invention, chlorine oxyanions may include for example, hypochlorite, chlorite, chlorate and perchlorate anions. Chlorine is further understood to include the terms "free chlorine" wherein the total concentration of dissolved chlorine, hypochlorous acid and hypochlorite ion are measured. A person of ordinary skill in the art will appreciate that different chlorine species predominate at differing pHs as a result of the reactivity of chlorine to pH.

The term "cleaning," as used herein, refers to performing or aiding in any soil removal, bleaching, microbial population reduction, or combination thereof.

The term "defoamer" or "defoaming agent," as used herein, refers to a composition capable of reducing the stability of foam. Examples of defoaming agents include, but are not limited to: ethylene oxide/propylene block copolymers such as those available under the name Pluronic N-3; silicone compounds such as silica dispersed in polydimethylsiloxane, polydimethylsiloxane, and functionalized polydimethylsiloxane such as those available under the name Abil B9952; fatty amides, hydrocarbon waxes, fatty acids, fatty esters, fatty alcohols, fatty acid soaps, ethoxylates, mineral oils, polyethylene glycol esters, and alkyl phosphate esters such as monostearyl phosphate. A discussion of defoaming agents may be found, for example, in U.S. Pat. Nos. 3,048,548, 3,334,147, and 3,442,242, the disclosures of which are incorporated herein by reference.

As used in this invention, the term "disinfectant" refers to an agent that kills all vegetative cells including most recognized pathogenic microorganisms, using the procedure described in AOAC Use Dilution Methods, Official Methods of Analysis of the Association of Official Analytical Chemists, paragraph 955.14 and applicable sections, 15th Edition, 1990 (EPA Guideline 91-2).

The terms "feed water," "dilution water," and "water" as used herein, refer to any source of water that can be used with the methods and systems of the present invention. Water sources suitable for use in the present invention include a wide variety of both quality and pH, and include but are not limited to, city water, well water, water supplied by a municipal water system, water supplied by a private water system, and/or water directly from the system or well. Water can also include water from a used water reservoir, such as a recycle reservoir used for storage of recycled water, a storage tank, or any combination thereof. It is to be understood that regardless of the source of incoming water for systems and methods of the invention, the water sources may be further treated within a manufacturing plant. For example, lime may be added for mineral precipitation, carbon filtration may remove odoriferous contaminants, additional chlorine or chlorine dioxide may be used for disinfection or water may be purified through reverse osmosis taking on properties similar to distilled water.

As used in this invention, the term "sanitizer" refers to an agent that reduces the number of bacterial contaminants to safe levels as judged by public health requirements. Preferably, sanitizers for use in this invention will provide at least a 99.999% reduction (5-log order reduction) using the Germicidal and Detergent Sanitizing Action of Disinfectants procedure referred to above.

The terms "solid" or "solid composition," as used herein, refer to a composition in the form of any solid, including, but not limited to a waxy powder, a flake, a granule, a powder, a pellet, a tablet, a lozenge, a puck, a briquette, a brick, a solid block, or a unit dose.

The term "sterilant," as used herein, refers to a physical or chemical agent or process capable of destroying all forms of life (including bacteria, viruses, fungi, and spores) on inanimate surfaces. One procedure is described in AOAC Sporicidal Activity of Disinfectants, Official Methods of Analysis of the Association of Official Analytical Chemists, paragraph 966.04 and applicable sections, 15th Edition, 1990 (EPA Guideline 91-2).

The terms "weight percent," "wt-%," "percent by weight," "% by weight," and variations thereof, as used herein, refer to the concentration of a substance as the weight of that substance divided by the total weight of the composition and multiplied by 100. It is understood that, as used here, "percent," "%," and the like are intended to be synonymous with "weight percent," "wt-%," etc.

The methods, systems, apparatuses, and compositions of the present invention can include, consist essentially of, or consist of the component and ingredients of the present invention as well as other ingredients described herein. As used herein, "consisting essentially of" means that the methods, systems, apparatuses and compositions may include additional steps, components or ingredients, but only if the additional steps, components or ingredients do not materially alter the basic and novel characteristics of the claimed methods, systems, apparatuses, and compositions.

The invention provides a method for increasing the alkalinity of an ash-based detergent. In particular, the invention increases alkalinity of the ash-based detergent by increasing the ratio of alkalinity contributed from sodium hydroxide versus the alkalinity contributed from ash in a detergent use solution. One skilled in the art shall ascertain that an ash-based detergent lacks sodium hydroxide alkalinity. According to an embodiment of the invention the alkalinity ratio of ash to hydroxide is increased from 100:0 to 90:10 to provide additional alkalinity attributed to hydroxide in the detergent use solution. Preferably the alkalinity ratio of ash to hydroxide is increased to 80:20, more preferably from 75:25 and most preferably from at least 70:30 with optimization.

As a result of increasing the alkalinity ratio of ash to hydroxide in an ash-based detergent, an improved performance of the ash-based detergent is obtained. The alkalinity enhanced ash-based detergent of the present invention becomes more suitable for tough soils and stains compared to a traditional ash-based detergent. As set forth in the Examples, there is an unexpected and significant boost in performance of the detergents according to the invention such that the improved ash-based detergents provide at least the same detergency as caustic detergent while maintaining the sustainable and nonhazardous chemistry of an ash-based detergent.

The present invention overcomes the shortfalls of prior art related to electrolysis methods and the recirculation of electrolytic solutions in a system. For example, U.S. Pat. Nos. 7,413,637 and 7,816,314 (incorporated by reference herein in its entirety) disclose the recirculation of a water source, such as tap or a recirculated wash or rinse liquor. This type of recirculation is distinct from the present invention's recirculation of a concentrated detergent use solution from a dispensing system to enhance the alkalinity of the use solution. In addition, according to one embodiment, after sufficient recirculation of the anode output to the cathode chamber of the cell the present invention allows the combination of the outputs from both chambers of a cell to ensure that the wash formula ingredients from the concentrated detergent supplied from a dispensing system to the cell are retained, rather than splitting the anode and cathode streams in the wash process for separate applications. Beneficially, the combination of both chambers of the electrolytic cell of the invention preserves any wash formula ingredients, including for example, polymers in the detergent use solution produced according to the invention. However, as one skilled in the art will ascertain, the present invention is further suitable for use in providing two product streams according to an embodiment of the methods disclosed herein (e.g. a separate carbonate, bicarbonate or sesquicarbonate stream recirculating on the anode side with detergent solution passing through the cathode side to increase alkalinity).

The present invention utilizes the electrolytic process in an electrolytic cell according to the invention to drive off $CO_2$ from an ash source (i.e. the concentrated detergent solution dispensed into the cell) and convert to NaOH alkalinity. Although the use of electrolysis to create various bleach solutions is known, the present invention does not require halide salt compositions and/or generation of bleach solutions. Rather, the present invention beneficially creates an electrolytic cell output with an enhanced alkalinity as a result of decreasing $CO_2$ from an ash source in favor of increasing NaOH alkalinity. The output from the at least two-chambered electrolytic cell is a concentrated detergent use solution that beneficially retains the polymers of the detergent with the addition of NaOH alkalinity.

Compositions

According to an embodiment of the invention, ash-based detergents are used to electrochemically obtain alkalinity-enhanced detergent compositions. As used herein, an ash-based detergent generally refers to a sodium carbonate detergent. Ash-based detergents according to the invention can further include other alkali metal carbonate, such as potassium carbonate. The scope of the invention is further understood to include bicarbonate and sesquicarbonate detergent compositions. As used herein, the terms "ash-based" and "alkali metal carbonate" shall be understood to include all alkali metal carbonates, bicarbonates and sesquicarbonates. The ash-based detergents for use according to the invention comprise, consist and/or consist essentially of an alkali metal carbonate, surfactant and a chelating agent. An example of a suitable ash-based detergent for use according to the invention may comprise, consist and/or consist essentially of about 10 to 99 wt-% alkali metal carbonate, preferably about 50 to 90 wt-% alkali metal carbonate; about 1 to about 50 wt-% surfactant, chelating agent and other ingredients (including for example water conditioners and defoamers), preferably about 10 to 30 wt-% surfactant, chelating agent and other ingredients. Commercially available ash-based detergents include Apex® (Ecolab, Inc.). According to an embodiment of the invention, it is desirable that no additional products are added to the ash-based detergent itself for the in situ alkalinity boost achieved according to the invention.

According to a further embodiment of the invention, the ash-based detergents suitable for use according to the invention may further comprise and/or add a salt to the composition. Addition of a salt to the ash-based detergent for use in the methods of the invention would generate chlorine in addition to the hydroxide alkalinity and may be suitable for certain applications of the alkalinity-enhanced detergent.

The ash-based detergent according to the invention may be either a solid or liquid formulation. Solid ash-based detergents provide certain commercial advantages for use according to the invention. Use of solid ash-based detergents decreases shipment costs as a result of the compact solid form, in comparison to bulkier liquid products. As a result, the remainder of the description of the invention references embodiments of the invention using solid ash-based detergents. However, one skilled in the art shall ascertain that such methods are not intended to be limited in scope according to the particular type of ash-based detergent, as the invention may also employ a liquid, semi-solid or other solid design formulation.

In certain embodiments of the invention, the solid products are provided in the form of a multiple-use solid, such as, a block or a plurality of pellets, and can be repeatedly used to generate aqueous use solutions of the ash-based detergent for multiple cycles or a predetermined number of dispensing cycles. In certain embodiments, the solid ash-based detergent has a mass of about 5 g to 10 kg. In certain embodiments, a multiple-use form of the solid ash-based detergent has a mass of about 1 to 10 kg. In further embodiments, a multiple-use form of the solid ash-based detergent has a mass of about 5 kg to about 8 kg. In other embodiments, a multiple-use form of the solid ash-based detergent has mass of about 5 g to about 1 kg, or about 5 g and to 500 g.

Regardless of the particular packaging of the solid ash-based detergent, the products are removed from any applicable packaging (e.g. film) and inserted directly into a dispensing apparatus according to the invention. Ideally, the solid ash-based detergent is configured or produced to closely fit the particular shape(s) of the dispensing system in order to prevent the introduction and dispensing of an incorrect solid product into the apparatus of the present invention.

Methods of Enhancing Alkalinity

According to an embodiment of the invention, electrolysis "boosts" or increases alkalinity through the production of hydroxide ions which enhances the ratio of hydroxide ions to carbonate alkalinity in an ash-based detergent. Electrolysis methods may be used to generate hydroxide alkalinity and/or chlorine in-situ. According to embodiments of the present invention, the hydroxide generation causes the increase in pH and improved cleaning efficacy of the resulting alkalinity enhanced ash detergent.

According to a further embodiment of the invention, electrolysis is used for the in-situ boost in alkalinity of an ash-based detergent to increase the alkalinity of a detergent use solution. Electrolysis methods are used according to this embodiment of the invention to increase the pH and improve cleaning performance of a use solution.

The methods of the present invention may comprise, consist of and/or consist essentially of providing an ash-based detergent to an electrochemical cell and undergoing electrolysis to enhance the alkalinity by increasing the ratio of hydroxide to carbonate alkalinity in the ash-based detergent. The providing of an ash-based detergent to an electrochemical cell may include the addition to an anode chamber or an anode chamber and cathode chamber. According to the invention the cathode chamber may be filed with either the detergent concentrate or water.

The methods of the present invention may further comprise, consist of and/or consist essentially of providing an ash-based detergent to an anode chamber of an electrochemical cell, undergoing electrolysis to enhance the alkalinity of the ash-based detergent, removing carbon dioxide from the sodium carbonate source and increasing hydroxide concentration, and generating a detergent use solution in situ for a cleaning application. The steps of increasing hydroxide concentration and generating a detergent use solution may further comprise, consist of and/or consist essentially of recycling the output from the anode chamber through the cathode chamber.

According to the invention, the increasing hydroxide concentration occurs in the cathode chamber of the electrochemical cell. According to a further embodiment of the invention, the generating of the detergent use solution includes the mixing or combining of the outputs from both chambers of the electrochemical cell. According to a preferred embodiment, the outputs from both the anode chamber and the cathode chamber (containing the hydroxide alkalinity) are combined.

Dispensing the Solid Detergent

According to an embodiment of the invention, a solid ash-based detergent is provided (i.e. dispensed) directly into an electrochemical cell using a solid detergent dispenser. For example, a solid detergent is added to a dispensing reservoir and is contacted with a water source, such as water sprayed on the bottom of solid block to dissolve detergent and provide a concentrated solution directly from a dispenser into an electrochemical cell. According to an embodiment of the invention, a water line and nozzle are used to spray water onto the solid detergent to dissolve the detergent into a use solution. The ash-based detergent use solution is preferably dispensed directly to an anode chamber of an electrolytic cell.

Figure 3:
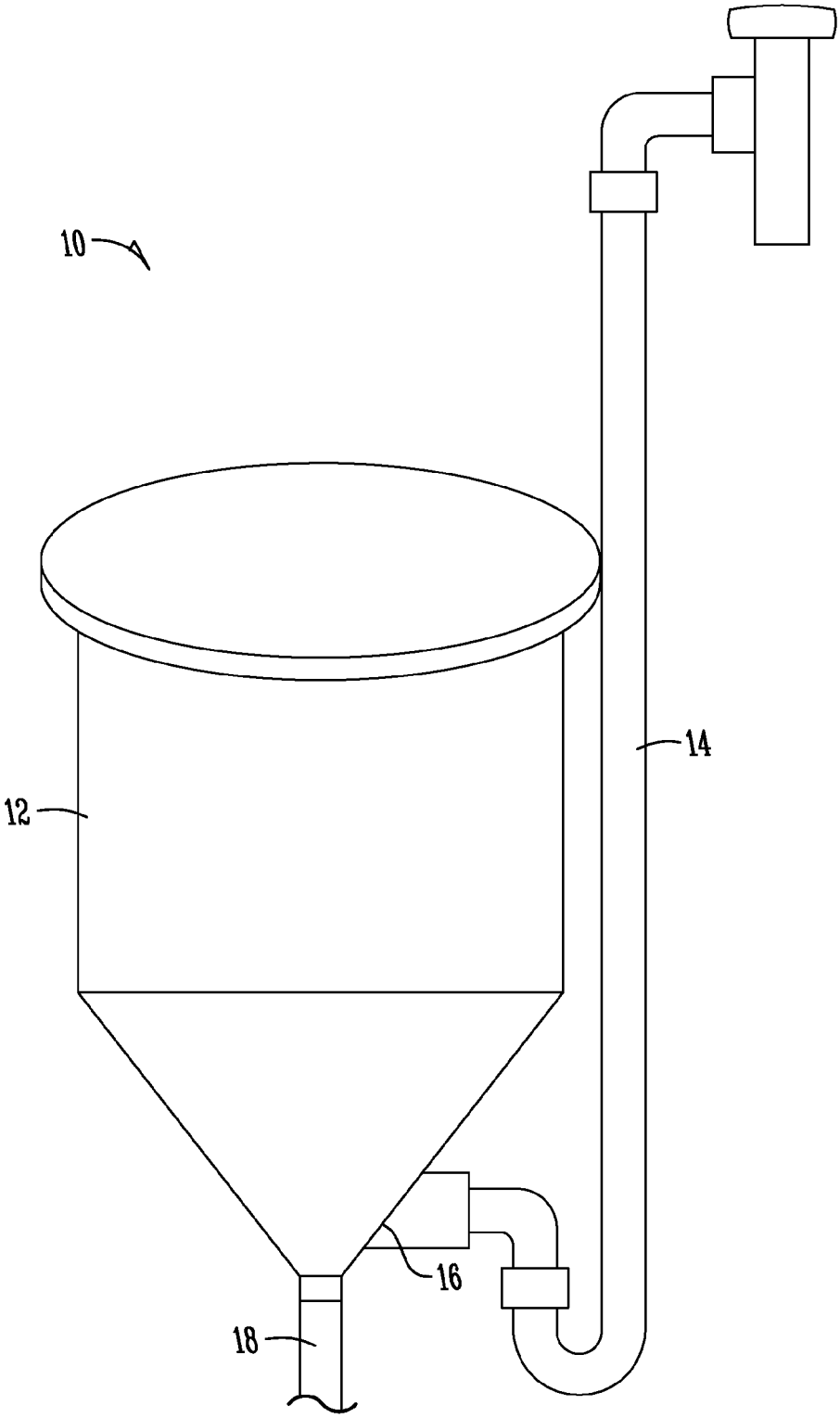
FIG. 3 is a perspective view of a detergent dispensing system suitable for use according to an embodiment of the invention.
Figure 4:
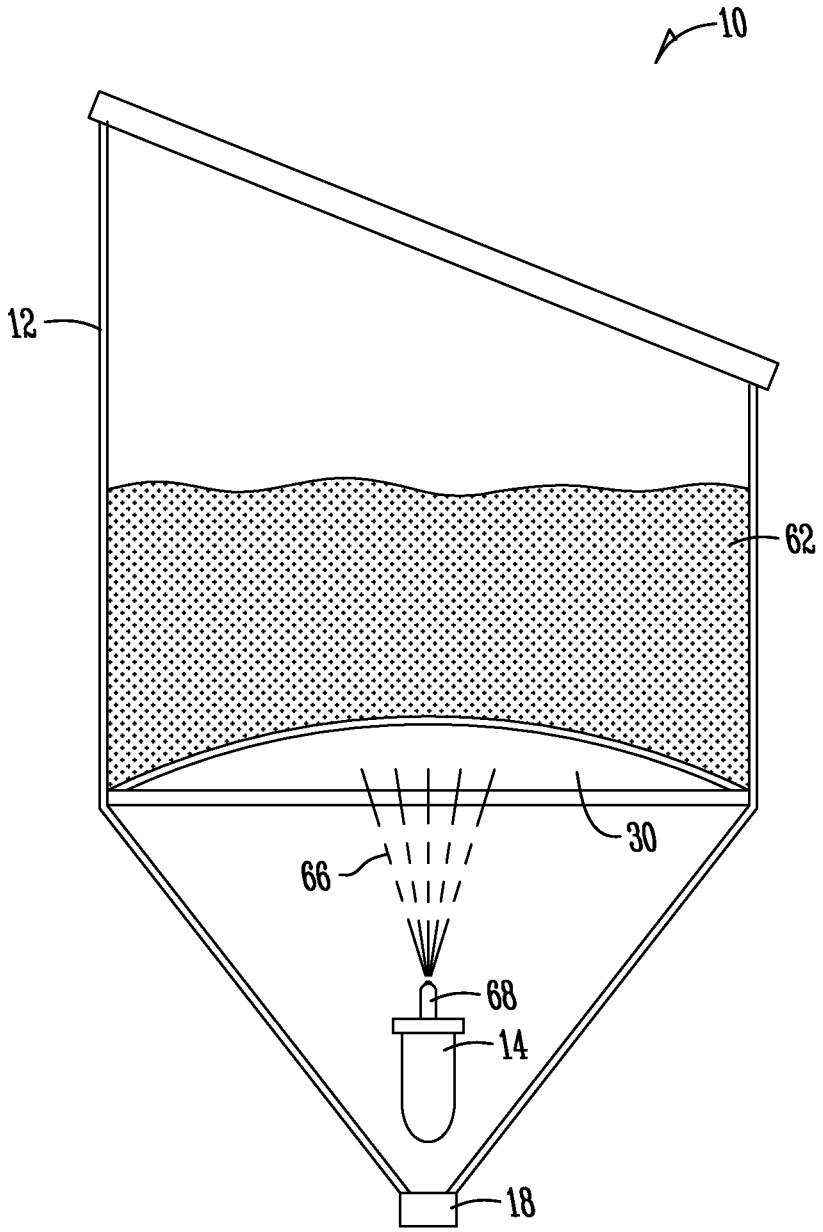
FIG. 4 is a further perspective view of a detergent dispensing system suitable for use according to an embodiment of the invention.

FIG. 3 and FIG. 4 are depictions of a dispensing system 10, such as a detergent dispensing system, suitable for use according to the present invention. Such dispensing systems are generally known and exemplary spray-type dispensers are disclosed, for example in U.S. Pat. Nos. 4,826,661, 4,690,305, 4,687,121, 4,426,362 and in U.S. Pat. Nos. Re 32,763 and 32,818, the disclosures of which are incorporated by reference herein in its entirety. The system 10 is designed to convert a solid detergent, particularly powders, into high strength detergent use solution (i.e. liquid) for dispensing into an anode chamber of an electrochemical cell for enhancing the alkalinity of the solid detergent. The system 10 includes a reservoir 12 for holding the detergent, a water line 14 connected to the reservoir 12 through a water line aperture 16, a nozzle 68 at the end of the water line 14, and a dispensing or output spout 18 at the bottom portion of the reservoir 12. According to an embodiment, the reservoir comprises a heavy duty, plastic.

The dispensing system 10 as shown in FIG. 3 and FIG. 4 is formulated to convert solid detergents, particularly powders to use solutions. Additional dispensing systems may also be utilized which are more suited for converting alternative solid detergents formulations into use solutions. The methods of the present invention include use of a variety of solid detergents, including, for example, extruded blocks or "capsule" types of package.

To use the dispenser, water is sprayed in a spray pattern 66 from the nozzle 68 and upwardly towards the screen 30 (or other apparatus holding the solid detergent within the reservoir 12) and the solid detergent 62. The water reacts with the solid detergent 62, which will drip downwardly due to gravity until the dissolved solution of the detergent is dispensed out of the spout 18 and into the electrochemical cell for electrolysis according to the methods of the present invention.

Electrolysis of Ash-Based Detergent

The use of an electrolytic cell according to the invention for the electrolysis of the alkali metal carbonate source can employ batch modes, continuous modes and/or semi-continuous modes. According to an embodiment, the alkali metal carbonate source, such as an ash-based detergent use solution, is added to an anode chamber of an electrochemical cell and undergoes electrolysis.

Upon supplying an electric current to the cell, water is oxidized in the anode chamber and reduced in the cathode chamber. The reaction in the cathode chamber produces hydroxide ions and hydrogen gas. The equilibrium chemistry of sodium carbonate (ash) and bicarbonate solutions and the need to maintain electrical neutrality in the cell results in $CO_2$ being liberated from the carbonate in the anode chamber and the sodium ion moving across the exchange membrane associating with the hydroxide ion produced by the reduction of water in the cathode chamber. According to an embodiment, the reaction may continue until the pH in the anode chamber reaches a specific value or the concentration of sodium hydroxide in the cathode reaches a specific level (as may be measured by pH). The methods for undergoing electrolysis may include the recirculation of the anolyte solution from the anode chamber into the cathode chambers. According to an embodiment, the solution is recirculated in the anode and cathode chambers until a set time or concentration of hydroxide alkalinity is achieved. The concentration of hydroxide alkalinity to be achieved according to the embodiments of the invention (and the time required to achieve such hydroxide alkalinity) will vary depending upon a variety of factors. As one skilled in the art shall ascertain, variations in flow rates and/or volumes in each chamber of the electrolytic cell will impact the time to reach a particular hydroxide alkalinity.

The alkalinity and concentration can be measured according to a variety of ways, including for example, pH, preset time, conductivity of the solution, titration, current and/or volts. Once the cathode chamber achieves the desired hydroxide alkalinity concentration the solution may be discharged to a day tank for dosing to a particular in situ cleaning application, such as a dish machine as dish washing process requirements demand.

According to an embodiment of the invention, a benefit of recirculating the anode and cathode chambers is a higher concentration output detergent use solution. In subsequent batches of electrolyzed solution the spent anode solution may be used as the new cathode solution. As a result, none of the ash-based detergent dispensed into the electrolytic cell is wasted. In addition, the remaining water treatment components pass through the cell and into the detergent use solution. An additional benefit of recycling the spent anode solution into the cathode chamber for the next batch is additional conversion of ash alkalinity to sodium hydroxide alkalinity.

According to an embodiment of the invention, the detergent use solution only requires small amounts of solution to be dispensed to the dish machine wash tank (or other in situ cleaning application). As a result, concerns around wash tank dilution and excess dispensed water impacting low water machine status are eliminated.

Although not intending to be limited according to any theory of the invention, there is a theoretical and practical limit to the conversion of ash to hydroxide alkalinity according to the invention. The theoretical limit occurs when the anode chamber reaches a neutral pH. If the anode is acidic and recycled into the cathode, hydroxide ions generated in the cathode will have to first neutralize the acid and the process will require excessive amount of time to accomplish and increase in alkalinity. According to a practical theory of the invention, the limit occurs at a pH of 9 or less.

One skilled in the art will ascertain, other flow through configurations are suitable for use and may be employed according to the invention. An embodiment of the invention may include a continuous method rather than a batch method. Such modifications will depend upon a number of considerations, including for example, the volume of the detergent use solution required for a cleaning application, the size and number of electrolytic cells employed, the number of electrolytic cells, configuration of electrolytic cells employed (e.g. in series or parallel), the number of electrodes, control system complexity, variations in flow rates and practical limits on flow rate control, and/or solution storage requirements.

Methods of measuring the concentration of hydroxide alkalinity and/or chlorine in-situ are included within the scope of the present invention, including applications in both batch and continuous methods of electrolysis and recirculation. The methods and systems of the invention may include a detection means for measuring the concentration of hydroxide alkalinity and/or chlorine in the electrolysis solution, including for example a pH probe that may be housed within the electrochemical cell. Examples of suitable measuring mechanisms for use in the invention as disclosed in more detail, for example in U.S. patent application Ser. No. 12/826,922, filed Jun. 30, 2010 the disclosure of which are incorporated by reference herein in its entirety.

According to an embodiment of the invention, the recycling of the ash-based detergent includes the use of the spent detergent concentrate to be added directly into a use solution. The exhausted ash-based detergent source contains polymers and other ingredients of benefit to the detergent use solution after undergoing electrolysis and these are not wasted according to the invention. The use of the exhausted ash-based detergent directly into the detergent use solution leaving the electrolytic cell ensures that no additional product waste stream is created as a result of the methods according to the invention.

According to an alternative embodiment of the invention, the anode and cathode streams may be separated and used for different purposes. For example, the stream from the anode chamber (having a pH of approximately 9) may be diverted for use as an alternative cleaning source/supply, such as a presoak solution or may be used as to create an acidic solution for alternative cleaning purposes. However, preferred embodiments of the invention combine the outputs from the electrolytic cell to provide a concentrated detergent use solution for an in situ cleaning application.

According to an embodiment of the invention, a high current (e.g. 25-30 Amps) at low voltage (e.g. 12-15 volts) are best suited for maximizing current efficiency of the electrolytic cell and minimizing time to reach the desired hydroxide concentration in the detergent use solution. According to an embodiment of the invention, higher current can be used to reduce production time.

Apparatus

Embodiments of the invention further include an apparatus for generating an alkalinity-enhanced ash-based detergent and/or detergent solution. According to the invention, the apparatus may comprise, consist of and/or consist essentially of an electrolytic cell that is either a stand-alone device or an electrolytic cell that is a component of a ware wash machine. One skilled in the art shall ascertain the benefits of both a stand-alone device and a machine housing a built-in electrolytic cell. According to an embodiment of the invention, an apparatus wherein the electrolytic cell is a component of a ware wash machine leverages the machine controls, power supply and other electronics, benefiting a user with cost effective manufacturing and installation along with providing seamless operation of the ware washing machine. However, providing an electrolytic cell as an additional or exterior component of a ware wash machine allows users to add or retro fit the alkalinity enhancing capabilities to an existing machine and/or detergent dispensing system.

The electrolytic cell according to the apparatus of the invention may have various structures, include a two or more chambered cell\. Preferably, the electrolytic cell is a two chamber cell consisting of an anode and cathode chamber, wherein the anode chamber houses anode electrode and the cathode chamber houses a cathode electrode, which may be configured using various materials suitable for generating hydroxide alkalinity from an ash-based detergent. According to a preferred embodiment, the anode is a titanium electrode, wherein the electrode is coated with a ruthenium oxide/iridium oxide blend (commercially available from Water Star, WS-15 material). According to a further embodiment, the cathode is a stainless steel electrode, such as a 316-SS cathode. According to a further embodiment, the two chamber electrolytic cell is separated by a membrane, such as a cation exchange membrane (commercially available, for example, Nafion 324).

One skilled in the art will ascertain that additional materials may be selected for use as electrodes according to the invention, including for example, aluminum, niobium, chromium, manganese, molybdenum, ruthenium, tin, tantalum, vanadium, zirconium, nickel, cobalt, copper, iridium, alloys of the same and combinations of the same known to one of ordinary skill in the art.

According to non-limiting embodiments of the invention, a variety of membranes may be used to separate the at least two chambers of the electrochemical cell. The membranes suitable for use according to the invention are generally flat diaphragms which separate the anolyte from the catholyte. According to the invention, more than one membrane or diaphragm can be utilized to create an electrochemical cell having at least two chambers, namely a cathode and anode chamber. Preferably, the membrane is a cation exchange membrane or a semi-permeable micro porous diaphragm. One skilled in the art will appreciate the various cation exchange membrane and semi-permeable micro porous diaphragms suitable for use in an electrochemical cell. For example, a commercially-available cation exchange membrane is a NAFION membrane (available from DuPont®).

As one skilled in the art will ascertain, various conventional electrochemical cells may be used according to the methods of the present invention. Electrolytic cells should be equipped with at least an anode and a cathode in the interior and often have a dual structure in which the anode and cathode are separated by a membrane to divide the cells into an anode chamber and a cathode chamber. The barrier membrane provides the advantage of preventing the products at the anode chamber from mixing with the products from the cathode chamber. A variety of cell structure designs may be utilized, including variations in the number of cell chambers, type of membranes, etc., which impact the products generated from a particular electrochemical cell. Various, non-limiting examples of electrochemical cell structures are disclosed, for example in U.S. Pat. No. 3,616,355, U.S. Pat. No. 4,062,754, U.S. Pat. No. 4,100,052, U.S. Pat. No. 4,761,208, U.S. Pat. No. 5,313,589, and U.S. Pat. No. 5,954,939.

The electrolytic cell according to the invention preferably has an independent recirculation means and plumbing between both the anode and cathode chambers. As one skilled in the art to which the invention pertains would ascertain, a recirculation and plumbing means for use in the electrolytic cell may have numerous variations. For example, according to an embodiment, a liquid degassing system may be employed to discharge $CO_2$ and $H_2$. According to further embodiments, check valves and other controls may also be employed in a liquid pumping system.

Methods of Use

The compositions, methods and apparatus according to the invention are suitable for use in various applications, including any application suitable for an ash-based product, such as a detergent where the ash is used to generate alkalinity for cleaning. The methods of the invention are particularly suited for the on-site production of the enhanced alkalinity detergents, in order to decrease or eliminate the need to transport caustic products and/or diluted aqueous solutions of the caustic products which both increase the cost of transporting chemicals. In addition, the on-site production of enhanced alkalinity products significantly reduces the safety concerns associated with the transport and handling of highly alkaline cleaning compositions which present dangers due to the caustic nature of the chemicals capable of causing burns to exposed skin, particularly in the concentrated form.

Examples of various applications of use for the enhanced alkalinity detergents include, for example, alkaline cleaners effective as grill and oven cleaners, ware wash detergents, laundry detergents, laundry presoaks, drain cleaners, hard surface cleaners, surgical instrument cleaners, transportation vehicle cleaning, dish wash presoaks, dish wash detergents, beverage machine cleaners, concrete cleaners, building exterior cleaners, metal cleaners, floor finish strippers, degreasers and burned-on soil removers. In a variety of these applications, cleaning compositions having a very high alkalinity are most desirable and efficacious.

In addition, the compositions, methods and apparatus according to the invention are suitable for applications wherein an ash-based product generates alkalinity for cleaning and the treated surface is rinsed with fresh water. For example, cleaning methods using an ash-based product and followed by fresh water rinse in order to remove any TDS films from a treated surface after washing (such as floor, laundry and CIP applications), are suitable according to the present invention.

Methods of use of the compositions and apparatus according to the invention are particularly suitable for institutional ware washing. In addition, the methods of use of the compositions and apparatus are also suitable for enhancing the alkalinity of ash-based laundry detergents, floor care products that incorporate a wash and rinse step, and CIP processes to replace the use of bulk caustic detergents. The methods of use may be desirable in additional applications where industrial standards begin to focus on the use of nonhazardous chemicals, such that ash-based detergents for creating alkalinity are desirable. Such applications may include, but are not limited to, vehicle care, industrial, hospital and textile care.

All publications and patent applications in this specification are indicative of the level of ordinary skill in the art to which this invention pertains. All publications and patent applications are herein incorporated by reference to the same extent as if each individual publication or patent application was specifically and individually indicated by reference.

EXAMPLES

Embodiments of the present invention are further defined in the following non-limiting Examples. It should be understood that these Examples, while indicating certain embodiments of the invention, are given by way of illustration only. From the above discussion and these Examples, one skilled in the art can ascertain the essential characteristics of this invention, and without departing from the spirit and scope thereof, can make various changes and modifications of the embodiments of the invention to adapt it to various usages and conditions. Thus, various modifications of the embodiments of the invention, in addition to those shown and described herein, will be apparent to those skilled in the art from the foregoing description. Such modifications are also intended to fall within the scope of the appended claims.

Example 1

A comparison of the cleaning performance of ash-based detergents and caustic detergents was conducted. Initial studies demonstrated that solid caustic detergents were able to remove more soil than a solid ash-based detergent. However, the addition of NaOH improved the soil removal efficacy of the ash-based detergent. The ability of a solid caustic detergent was compared to a solid ash-based detergent, with and without the addition of 10 and 30% NaOH to the ash-based detergent.

Soil removal was conducted in an AM-14 automatic dish machine with metal panels soiled with egg yolk. Approximately 0.5 yolks was deposited onto a clean and dry panel and spread into a uniform layer with a rolling bar. The soil set for 2 hours, exposed to near boiling water for 60 seconds in steam jacketed container, exposed to oven at approximately 200° F. for 2 hours and then allowed to cool. The soil was then washed in a machine with 1000 ppm detergent and 0 gpg high temperature water with a standard wash and rinse cycle with 5 minute wash cycle and 10 second rinse cycle. The percent soil removed was calculated. Panels were weighed individually on analytical balance as well as collectively for each set on standard balance. Five panels used for each set as well as an unsoiled control panel, at specified rack positions.

Results of the comparison testing showed that the amount of soil removed was heavily influenced by the amount of NaOH in a formula. Additional testing procedures were used to confirm efficacy of the initial procedures. Soil removal was conducted in an AM-14 automatic dish machine with metal panels soiled with egg yolk. Panels were washed by hand with 3-5% NaOH solution and DI water. Approximately 0.5 yolks was deposited onto a clean and dry panel and spread into a uniform layer with a rolling bar. The egg yolk was allowed to dry for 1 hour, then exposed to oven at approximately 200° F. for 3 hours, allowed to cool for 15 minutes (weighed dried panel with egg soil) and then washed in machine with 1000 ppm detergent and 0 gpg high temperature water with a standard wash and rinse cycle with 5 minute wash cycle and 10 second rinse cycle. Then panels were dried for 30 minutes at 200° F. for 30 minutes, cool for 15 minutes. Finally, dry panels were weighed to calculate percent soil removed Three panels were used for each set. Each detergent being tested was evaluated with 3 separate sets of panels.

The ability of a solid caustic detergent was compared to a solid ash-based detergent, with and without the addition of 10 and 30% NaOH to the ash-based detergent in these additional testing. The added NaOH represents 10 and 30% NaOH of the detergent composition used in the cleaning application. This changed the detergent composition as a result of adding hydroxide alkalinity and removing ash. However, in this testing, rather than adding NaOH to the overall formula and normalize the total amount, NaOH was added and Dense Ash removed from the formula in order to maintain similar amounts of total alkalinity while changing the amount of NaOH in the formula.

Figure 2:
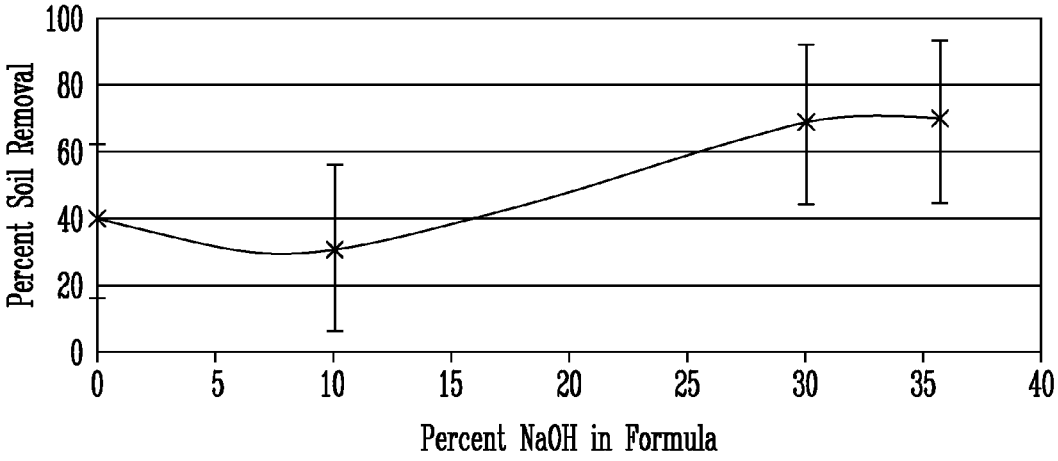
FIG. 2 shows overall percent soil removal of detergents according to percent sodium hydroxide in formula.

As shown in FIG. 1 and FIG. 2 there is a correlation between percent soil removal of egg yolk from metal panels in a high temperature automatic dishwasher and the percent NaOH in the detergent used to remove the soil. Testing has shown that an increasing amount of soil can be removed by a formula containing a larger amount of NaOH. The addition of NaOH demonstrated some improved performance of an ash-based detergent and suggests a trend toward arriving at the efficacy of the solid caustic detergent. The results demonstrate that ash-based detergents alone may provide insufficient soil removal under certain performance demands (in comparison to caustic products), despite the various benefits of using an ash-based detergent, including sustainability, handling and safety.

Example 2

Testing of ware wash applications to achieve an increase in $OH^-$ alkalinity in an ash-based detergent. The use of electrochemical water technology to increase $OH^-$ alkalinity in a use solution was analyzed. In addition, a primary goal of the analysis was to confirm the ability to increase $OH^-$ alkalinity without the requirement of adding any additional chemical products and/or generating any additional waste streams.

A ware wash application tested a 5% ash-based detergent that was recirculated through both sides of a two chamber cell. An electrolyte having a pH from about 12.8-13.0 was obtained in the cathode chamber and a pH from about 9.3-9.8 was obtained in the anode chamber. Initial analysis demonstrated a ratio of percent alkalinity resulting from ash to caustic improve from approximately 100:0 to approximately 90:10. The subsequent "recycling" of the anode stream into the cathode chamber for subsequent electrolysis for further increase in the hydroxide alkalinity resulted in an improvement in alkalinity ratio to approximately 80:20. The results demonstrate that electrochemical water and electrolytic cell technology can be used to increase $OH^-$ alkalinity in an ash-based detergent, including Apex® (commercially available from Ecolab, Inc.).

Example 3

A comparison of the cleaning performance of ash-based detergents and caustic detergents was conducted, demonstrating that an increase in the concentration of alkalinity from sodium hydroxide to ash improves detergency. Hydroxide alkalinity was generated in a carbonate detergent use solution as a result of recycling the "spent" anode solution into the cathode. Table 1 shows the pH measured over time in the electrochemical cells used to increase the sodium hydroxide concentration.

TABLE 1

| Batch | Run Time (hours) | Cathode pH | Anode pH |
|---|---|---|---|
| 1 | 3.5 | 12.9 | 9.3 |
| 2 | 2.5 | 12.9 | 9.8 |
| 3 | 2.25 | 13.3 | 6.1* |

*depleted Apex used as Cathode feed/fresh Apex to Anode

In batch 1 and 2 a 5% Apex solution was input to both the anode and cathode and recirculated until a pH of around 13 was achieved in the cathode solution. In batch 3 the anode solution from batch 1 and 2 were combined and recirculated in the cathode. Fresh 5% Apex solution was added to the anode. Sodium ion balance calculations were completed and confirmed the increase in hydroxide concentration obtained in the detergent use solution according to the methods of the present invention.

Figure 5:
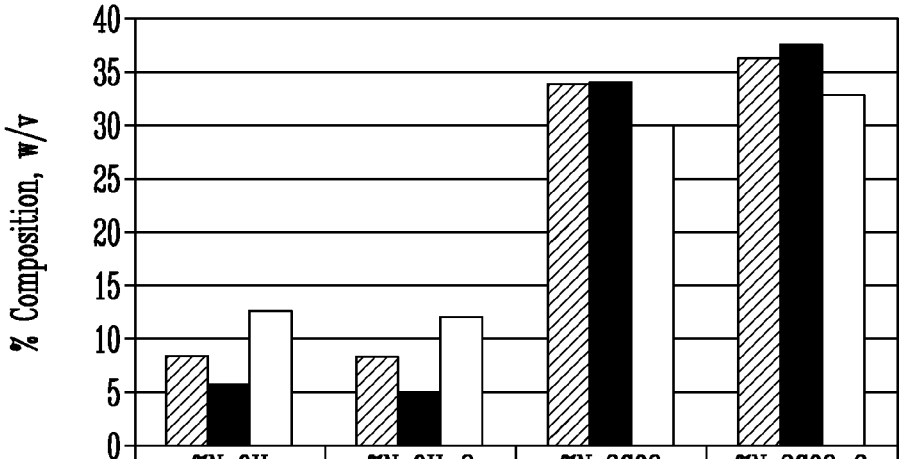
FIG. 5 shows a comparison of increased alkalinity of ash-based detergents as a result of increased concentration of alkalinity from sodium hydroxide according to an embodiment of the invention.

As shown in FIG. 5 batch 1 and 2 show generation of NaOH alkalinity resulting in a ratio of 10-15% OH alkalinity: 90-85% carbonate (ash) alkalinity. Batch 3 shows an improvement of this ratio to 20:80. (note Apex Power before electrolysis results in a ratio of 0:100 and a pH of 10.1-10.4) The optimization of design and process appears to provide a ratio of about 25:75 OH:ash alkalinity according to the methods of the invention.

Example 4

Method for Enhancing Alkalinity. Methods and apparatus for generating a "boosted" ash-based detergent solution are described. The apparatus is a two chamber electrolytic cell consisting of a titanium electrode coated with ruthenium oxide/iridium oxide blend as the anode (Water Star, WS-15 material), a Nafion 324 cation exchange membrane and a 316-SS cathode. Both the anode and cathode chamber have independent recirculation means and plumbing. A use solution day tank was also used for storage of the detergent use solution.

A solid ash-based detergent (Apex) was dispensed using a water spray on the bottom of solid block to dissolve detergent. The concentrated solution flows from the dispenser into the anode chamber of the electrolytic cell. The electrolytic cell is part of a dish machine equipment and leverages the dish machine controls, power supply and other electronics, making it a seamless operation for the customer, and more cost effective to manufacture. However, as one skilled in the art shall ascertain, the electrolytic cell could be a stand-alone device outside of the dish machine or part of the detergent dispensing system instead should other requirements justify this configuration.

The electrolytic cell functions in a batch mode, recirculating solution in the anode and cathode chambers until a set time or concentration is achieved. Depending on the volume of use solution required and the size or number of electrolytic cells employed, other flow through configurations can be employed.

The electrolytic cell and recirculation plumbing volume are filled with concentrated Apex solution. For a machine with fresh water rinse flow rate of 2 liters per rack, an estimated recirculation volume of 5 liters will be required. Upon startup of the machine concentrated solution from the dispenser may also fill the cathode chamber of the cell or water may be used. In some embodiments of use, the anode has some conductive fluid in it to start operation, although conductive fluid is not necessary for starting the operation. Power is applied to the electrolytic cell and recirculation of the anode and cathode chambers begins.

Water is oxidized in the anode chamber and reduced in the cathode chamber. The reaction in the cathode chamber produces hydrogen gas. The equilibrium chemistry of sodium carbonate (ash) and bicarbonate solutions and the need to maintain electrical neutrality in the cell results in $CO_2$ being liberated from the carbonate in the anode chamber and the sodium ion moving across the exchange membrane associating with the hydroxide ion produced by the reduction of water in the cathode chamber. The reaction continues until the pH in the anode chamber reaches a specific value or the concentration of sodium hydroxide in the cathode reaches a specific level (as measured by pH).

Results show that high current 25-30 amps at low voltage 12-15 volts are ideal for maximizing current efficiency of the cell and minimizing time to reach concentration. Recirculation flow rate also contributes to cell efficiency. Higher current can be used to reduce production time. The benefit of recirculating the anode and cathode chambers is a higher concentration output solution which only requires small amounts of solution be dispensed to the dish machine wash tank. As a result, concerns around wash tank dilution and excess dispensed water impacting low water machine status are eliminated.

Once the cathode chamber is up to concentration the solution is discharged to the day tank for dosing to the dish machine as dish washing process requirements demand. In subsequent batches of electrolyzed solution the spent anode solution becomes the new cathode solution. In this manner none of the Apex product is wasted. All the additional water treatment components pass through the cell and into the use solution. An additional benefit of recycling the spent anode solution into the cathode chamber for the next batch is additional conversion of ash alkalinity to NaOH alkalinity.

The inventions being thus described, it will be obvious that the same may be varied in many ways. Such variations are not to be regarded as a departure from the spirit and scope of the inventions and all such modifications are intended to be included within the scope of the following claims.

What is claimed is:

1. A method of electrochemically increasing alkalinity of a detergent comprising:

providing a detergent comprising a carbonate source to an anode chamber of an electrolytic cell, wherein said carbonate source is an alkali metal carbonate, bicarbonate or sesquicarbonate and wherein said detergent is free of halide salts;

causing the carbonate source to undergo electrolysis, wherein said electrolysis removes carbon dioxide from said carbonate source, and wherein said increased alkalinity is a result of increased hydroxide concentration and decreased carbon dioxide concentration;

recirculating the anolyte solution from the anode chamber directly into the cathode chamber; and generating a detergent use solution having increased hydroxide alkalinity compared to the original carbonate source supplied to the electrolytic cell, wherein the generated ratio of ash to hydroxide alkalinity in the detergent use solution is decreased from about 100:0 to between about 95:5 to about 70:30.

2. The method of claim 1 wherein said carbonate source is a sodium carbonate detergent.

3. The method of claim 2 wherein water is provided to a cathode chamber.

4. The method of claim 2 wherein said sodium carbonate detergent further comprises polymers and other ingredients and further comprising the step of adding an exhausted sodium carbonate detergent into said detergent use solution.

5. The method of claim 1 wherein the generated ratio of ash to hydroxide alkalinity in the detergent use solution is from about 90:10 to about 80:20.

6. The method of claim 1 wherein the generated ratio of ash to hydroxide alkalinity in the detergent use solution is from about 80:20 to about 70:30.

7. The method of claim 1 wherein said carbonate source is solid sodium carbonate detergent that is dispensed directly into said electrolytic cell in the form of a concentrated detergent solution.

8. The method of claim 1 wherein an anode stream is recirculated into a cathode chamber for additional electrolysis within the electrolytic cell until an ash to hydroxide alkalinity ratio of from about 90:10 to about 85:15 is obtained in the detergent use solution.

9. The method of claim 1 wherein the generation of the detergent use solution is a continuous or batch mode.

10. The method of claim 1 wherein said detergent use solution provides essentially the same detergency as a caustic detergent.

11. A method of increasing alkalinity of a detergent use solution on site comprising:

adding a sodium carbonate detergent source consisting essentially of sodium carbonate, surfactant, and chelating agent to an anode chamber in an electrolytic cell;

causing the sodium carbonate detergent source to undergo electrolysis, recirculating the anolyte solution from the anode chamber directly into the cathode chamber, wherein the detergent source is a concentrated detergent solution from a dispenser;

decreasing the ratio of ash to hydroxide alkalinity from about 100:0 to between about 95:5 and about 80:20 in a detergent use solution, wherein the detergent use solution does not require the addition of other chemical products for effective detergency; and providing said detergent use solution to an onsite cleaning application.

12. The method of 11 wherein water is provided to a cathode chamber of an electrolytic cell.

13. The method of claim 11 wherein said sodium carbonate detergent source is provided to both an anode chamber and a cathode chamber of an electrolytic cell.

14. The method of claim 11 wherein the ratio of ash to hydroxide alkalinity is further decreased to between about 80:20 and about 70:30.

15. The method of claim 11 wherein an exhausted detergent source is added directly into said detergent use solution.

16. The method of claim 11 wherein an anode stream is recirculated into a cathode chamber for additional electrolysis within the electrolytic cell until an ash to hydroxide alkalinity concentration of from about 90:10 to about 85:15 is obtained in the detergent use solution.

17. The method of claim 11 wherein the generation of the detergent use solution is a continuous or batch mode.

18. The method of claim 11 wherein said detergent use solution provides essentially the same detergency as a caustic detergent.

19. The method of claim 11 wherein the surfactant and chelating agent are present in the detergent use solution between about 10-30 wt %.

20. The method of claim 11 wherein the providing the detergent use solution does not generate additional waste streams.

* * * * *